US005433097A

United States Patent [19]

Nord

[11] Patent Number: 5,433,097

[45] Date of Patent: Jul. 18, 1995

[54] HYDRAULIC CONTROL FOR PRESS BRAKES

[75] Inventor: Gerry A. Nord, Evansville, Ind.

[73] Assignee: Pacific Press & Shear, Inc., Mt. Carmel, Ill.

[21] Appl. No.: 33,294

[22] Filed: Mar. 12, 1993

[51] Int. Cl.[6] ..... B21T 7/28

[52] U.S. Cl. ..... 72/21; 72/19; 72/453.01; 100/48

[58] Field of Search ..... 72/26, 453.14, 453.01, 72/453.02, 12, 21, 19; 100/48, 269 R

[56] References Cited

U.S. PATENT DOCUMENTS

| | | | |
|---|---|---|---|
| 2,192,778 | 3/1940 | Stacy . | |
| 2,290,743 | 7/1942 | Ernst . | |
| 2,396,296 | 3/1946 | Stacy . | |
| 3,343,217 | 9/1967 | Daubenberger . | |
| 4,116,122 | 9/1978 | Linder et al. | 72/453.01 |
| 4,831,862 | 5/1989 | Ohashi et al. | 72/389 |

FOREIGN PATENT DOCUMENTS

| | | | |
|---|---|---|---|
| 0028626 | 2/1982 | Japan | 72/21 |
| 0006021 | 1/1990 | Japan | 72/21 |

*Primary Examiner*—David Jones
*Attorney, Agent, or Firm*—Arnold, White & Durkee

[57] ABSTRACT

A method and apparatus for controlling the stopping position of a press brake punch is provided. Hydraulic control is provided so that the variations in punch stopping positions due to variations in manifold valve response times are minimized. A variable displacement hydraulic pump and a solenoid valve are used in conjunction with manifold valves in order to precisely stop a press brake punch. When it is desired to stop the punch, the solenoid valve is shifted and pump output begins to decrease before the manifold valves begin to shift.

12 Claims, 6 Drawing Sheets

HYDRAULIC CONTROL FOR PRESS BRAKES

BACKGROUND OF THE INVENTION

The present invention relates to hydraulic press brakes. More particularly, a method and apparatus for controlling the hydraulics of a press brake is provided.

Hydraulically driven press brakes are generally used for forming or bending metal. A press brake includes a stationary bed and a ram mounted above the bed. The ram is movable such that a workpiece placed between the ram and bed may be formed as the ram and the bed are brought together. The final shape of the workpiece is determined by the shape of the dies used in the forming process. Generally, a male die or a punch, is attached to the ram and a female die is attached to the bed.

Typically a hydraulic press brake has a rigid frame and hydraulic cylinders that drive the ram down towards the bed. A variety of mechanical methods used for attaching the male die or punch to the ram and the female die to the bed are known to those skilled in the art. A workpiece is formed into a shape as the ram is pushed down towards the bed. The hydraulic pressure in the cylinders supplies enough force so that the metal is formed into a shape that is governed by the opening of the female die.

When forming a workpiece, it is desired to repeatedly obtain the same shape from piece to piece. Repeatedly obtaining the same shape will help assure that the workpieces will perform the task for which they are intended. To obtain this piece to piece precision, several variables in the press brake must be controlled. For example, the method of controlling the position at which the downward motion of the punch is stopped will impact the shape of the workpiece that is formed. Thus, the downward position at which the punch is stopped in relation to the female die is an important variable in repeatedly obtaining a precise workpiece.

The ability to accurately stop the punch at the same position relative to the female die is highly dependent upon how fast the speed of the punch can be slowed to zero and how pressure from the output of a hydraulic pump is delivered to the cylinders. For example, a typical press brake contains a system of manifold valves or other flow bleed off mechanisms between the hydraulic pump and the press brake cylinders. When it is desired to stop the punch, hydraulic fluid from the pump is diverted or bypassed from the manifold valve system back to the hydraulic fluid reservoir. Thus, less fluid is directed to the cylinders and consequently the ram travels at a slower speed. One type of fluid bypass system is disclosed in U.S. Pat. No. 3,343,217 to Daubenberger. However, bypass systems do not provide precise and repeatable stopping positions because they often have response lag times that may vary from workpiece to workpiece.

Variable hydraulic pumps have also been used to control rams. For example, U.S. Pat. No. 2,396,296 to Stacey discloses a variable displacement pump that adjusts the pressure delivered to a ram. Further, U.S. Pat. No. 4,116,122 to Linder et al. discloses a hydraulic system in which the pump volume is controlled electronically through servo valves to vary the pump flow and the punch speed. This patent discloses utilizing a changing, stepped, ram speed to perform fine bending. Generally, servo valves require sophisticated microelectronic control and the accuracy of such valves is dependent upon the system hydraulic pressure level. Often such valves even utilize an external pressure source to operate properly.

It is desired to provide an alternative method to control the hydraulic pump output and the punch stopping point. It is desired to achieve a more repeatable punch stopping position so that workpieces may be formed more precisely with less variation between workpieces. It is also desired to provide quicker, smoother, and more complete ram speed deceleration to a zero speed. Furthermore, it is desired to achieve such objectives with a more economical system then servo valves and a system that is not as dependent upon the system hydraulic pressure level for fine accuracy. Finally, it is desired to achieve such objectives with a press brake that does not require stepped ram speeds.

SUMMARY OF THE INVENTION

The present invention in a broad aspect comprises a method and apparatus for hydraulically controlling a press brake. Press brake movements may be stopped precisely be using a variable displacement pump. The output of the pump may be decreased in order to provide an accurate stopping position for the press brake ram. Furthermore, a manifold valve system may also contribute to stopping the ram by diverting hydraulic fluid flow away from the cylinders that drive the ram. The output of the pump and the diversion of hydraulic fluid flow by the manifold valves are generally responsive to a position signal generated by the press brake. The manifold valves typically have a response lag time before fluid is diverted. In an embodiment of the claimed method, the pump output begins to decrease during the response lag time of the manifold valve system. Thus, inaccuracies in a formed workpiece resulting from variations in the response lag time are decreased because the ram is already moving at a slower speed during the lag time.

The apparatus of the claimed invention comprises a workpiece forming apparatus that has a hydraulic control system. The forming apparatus may be, for example, a press brake. The press brake generally includes a ram and a bed. The downward movement and stopping point of the ram may be precisely controlled by the hydraulic system. The hydraulic system includes a variable displacement pump that has a remote pressure compensation valve. The remote pressure compensation valve may be connected to a solenoid valve, which in turn is connected to the hydraulic fluid reservoir. When it is desired to stop the ram, the solenoid valve is shifted, thus causing the output of the pump to drop. Connected to the output of the pump is a manifold valve system. The manifold valve system may be used to direct fluid to the press brake cylinders. When it is desired to stop the ram, the manifold valves are also shifted, thus causing fluid flow to be divert from the cylinders.

BRIEF DESCRIPTION OF THE DRAWINGS

So that the manner in which the described advantages and features of the present invention, as well as others which will become apparent, are attained and can be understood in detail, more particular description of the invention summarized above may be had by reference to an embodiment which is illustrated in the appended drawings, which drawings form a part of this specification.

DETAILED DESCRIPTION OF THE PREFERRED EMBODIMENTS

Figure 1A:
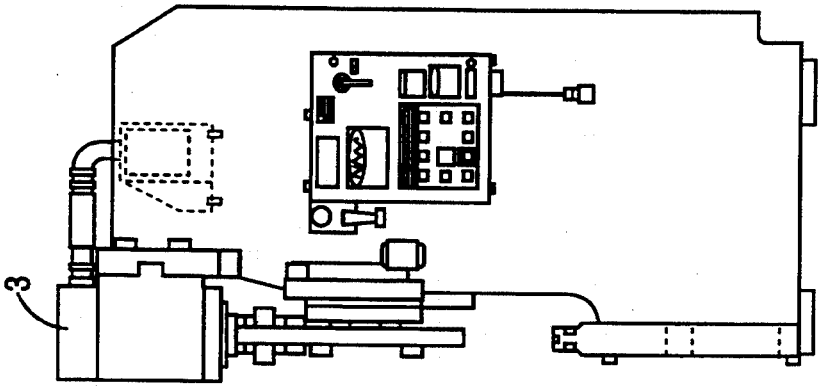
FIG. 1A (Prior Art)
FIG. 1A is a side view of the press brake shown in FIG. 1.
Figure 1:
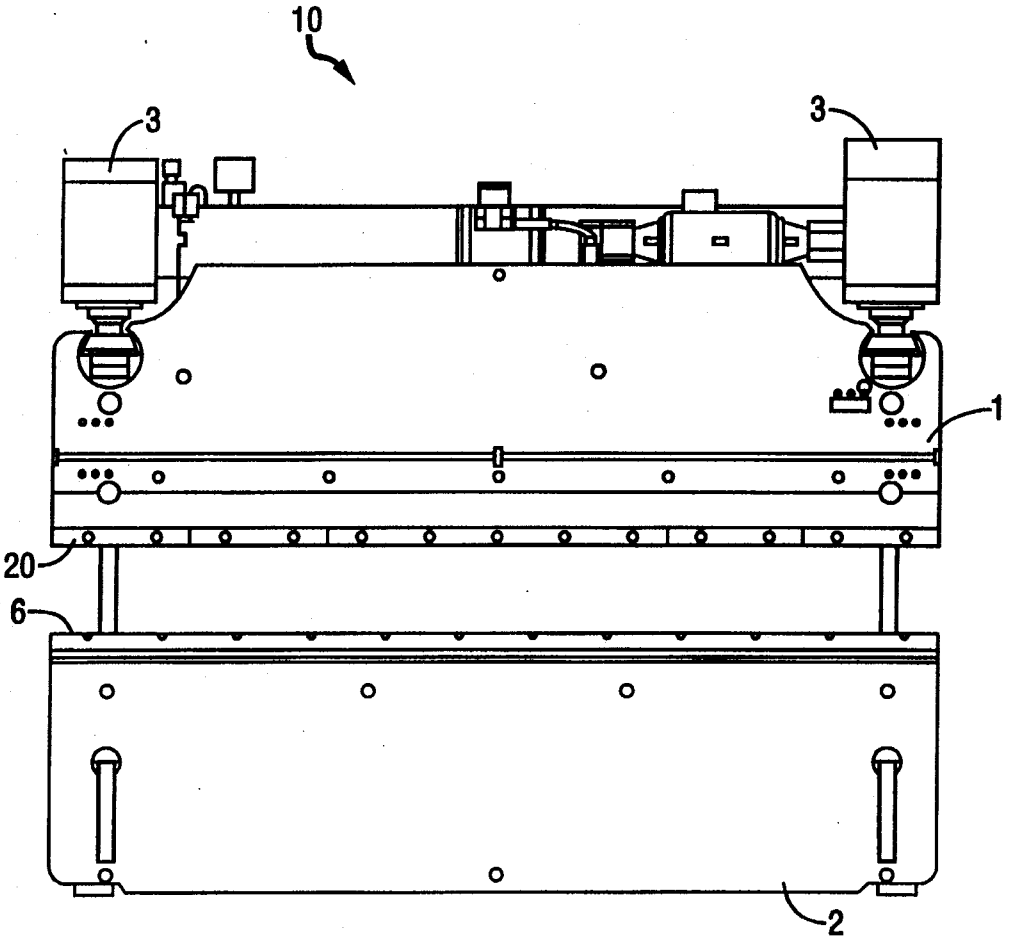
FIG. 1 (Prior Art)
FIG. 1 is a front view of a press brake.
Figure 2:
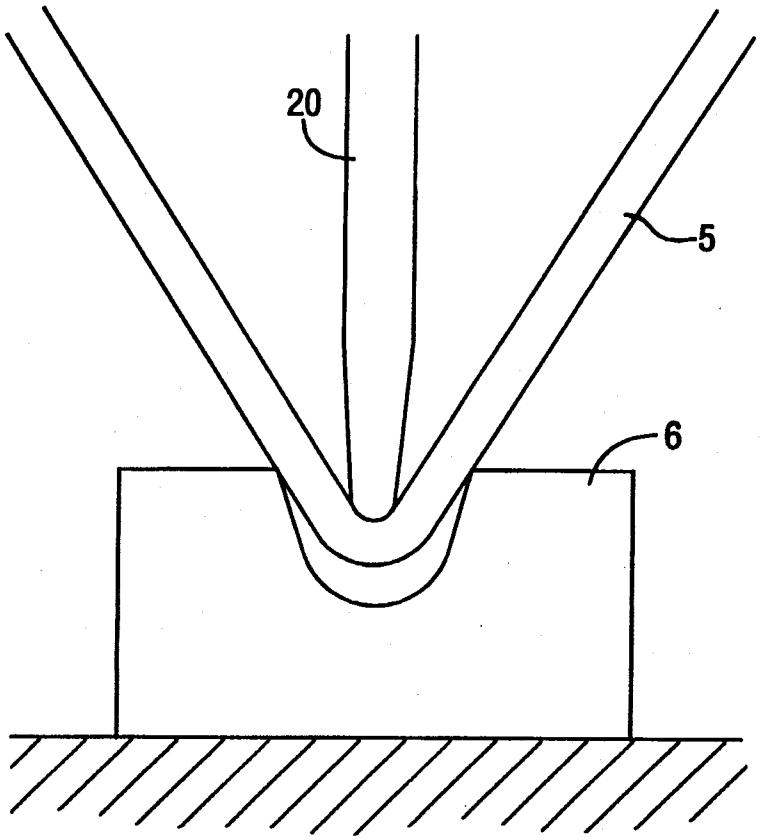
FIG. 2 (Prior Art)
FIG. 2 is a cross-sectional view of a workpiece being formed between a punch and a female die.

FIG. 1 illustrates typical hydraulic press brake 10. Press brake 10 includes ram 1 and bed 2. Hydraulic cylinders 3 are used to move ram 1 towards bed 2. Attached to ram 1 is male die or punch 20. Attached to bed 2 is female die 6. FIG. 1A shows a side view of press brake 10. FIG. 2 shows workpiece 25 being formed between punch 20 and female die 6. As punch 20 travels increasing distances downward toward female die 6, the shape of workpiece 25 varies.

Figure 3:
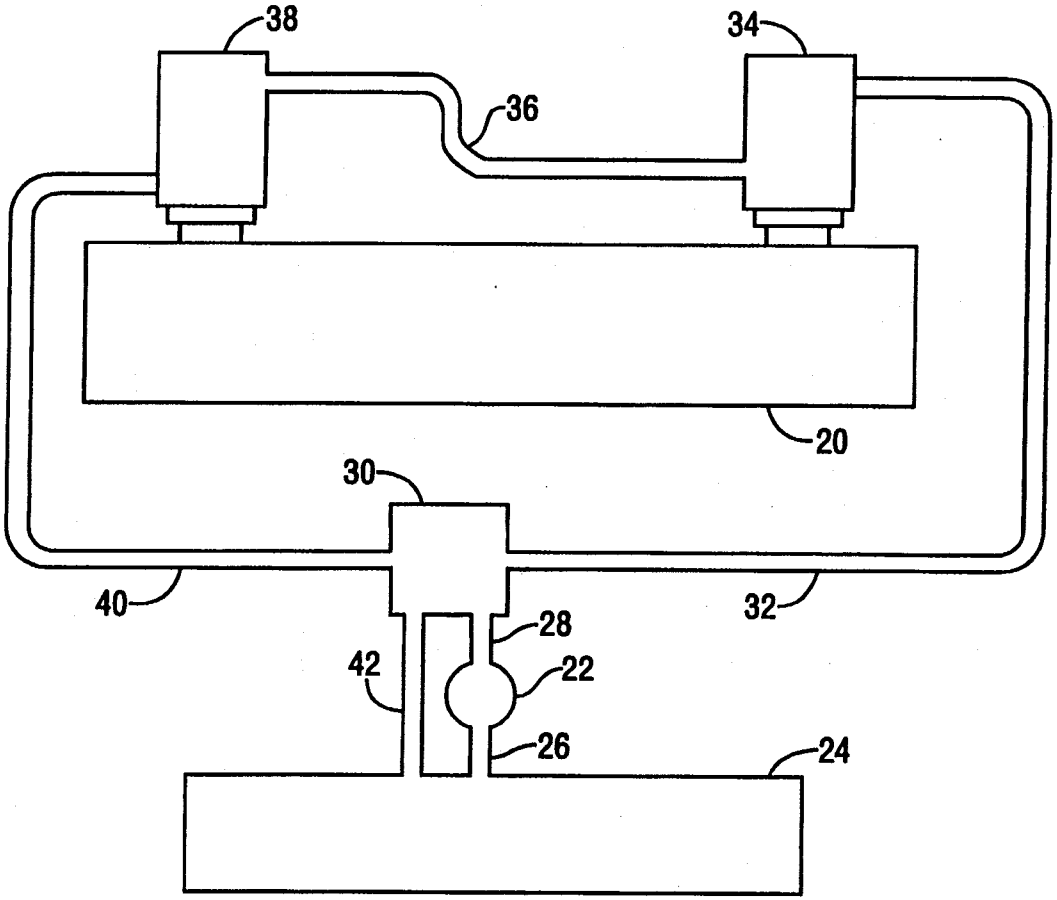
FIG. 3 (Prior Art)
FIG. 3 is a schematic view of a prior art hydraulic control system for a press brake.
Figure 5:
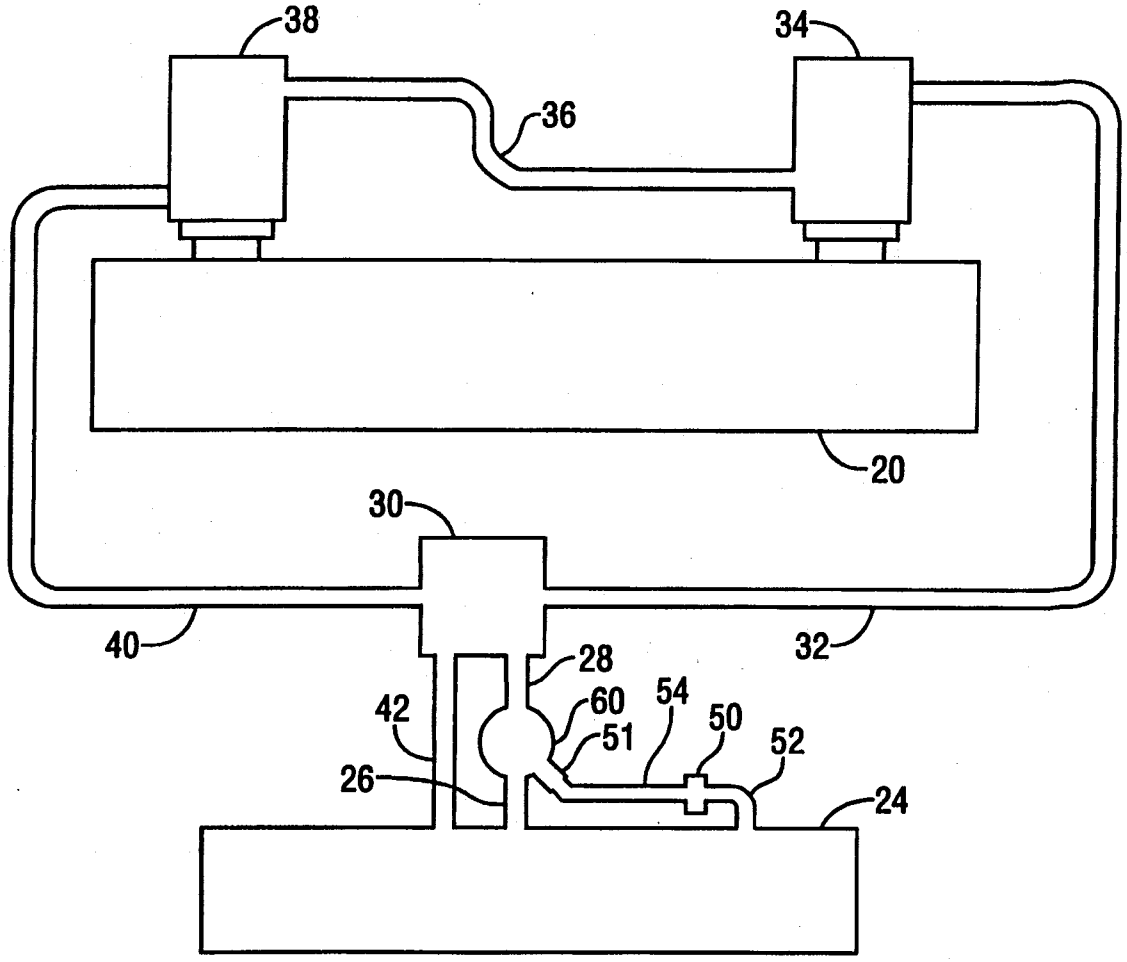
FIG. 5 is a schematic view of the hydraulic control system for a press brake according to the present invention.

A prior art hydraulic system for a press brake is shown in FIG. 3. To cycle punch 20 downward, pump 22 forces fluid from hydraulic fluid reservoir 24 through hydraulic lines 26 and 28 to a system of manifold valves 30. Manifold valves 30 and pump 22 are known in the art and thus have been shown only diagrammatically. Manifold valves 30 are shown as a single block but in practice may represent a system of valves known in the art and used to control hydraulic fluid flow. Pump 22 may be, for example, a fixed vane pump such as the Dennison T6CC022-006-5R03C1 available from Hagglunds Dennison. Other known valves and pumps, though, are often used. Manifold valves 30 direct fluid to hydraulic line 32 and cylinder 34. The piston of cylinder 34 is then forced down by this fluid, thus transferring force to punch 20. Simultaneously, fluid is forced out of cylinder 34 through hydraulic line 36 into cylinder 38. Thus, cylinder 38 also forces punch 20 downward. Cylinders 34 and 38 may be synchronized by methods known in the art, and the method shown in FIGS. 3 and 5 is used only for illustration. Fluid returns to manifold valves 30 and reservoir 24 through hydraulic lines 40 and 42. An example of a commercially available press brake such as shown in FIG. 3 is the J-Series Press Brake available from Pacific Press & Shear, Inc.

In a prior art hydraulic system such as shown in FIG. 3, when it is desired to stop the downward movement of punch 20, a position signal is delivered to manifold valves 30. Preferably, such a signal may be generated by a cam which contacts a limit switch when the desired position of punch 20 is reached. The limit switch then generates an electrical signal that is delivered to manifold valves 30. Other methods are known in the art and may be used, though, to generate a position signal and to deliver that signal to the valves.

Figure 4:
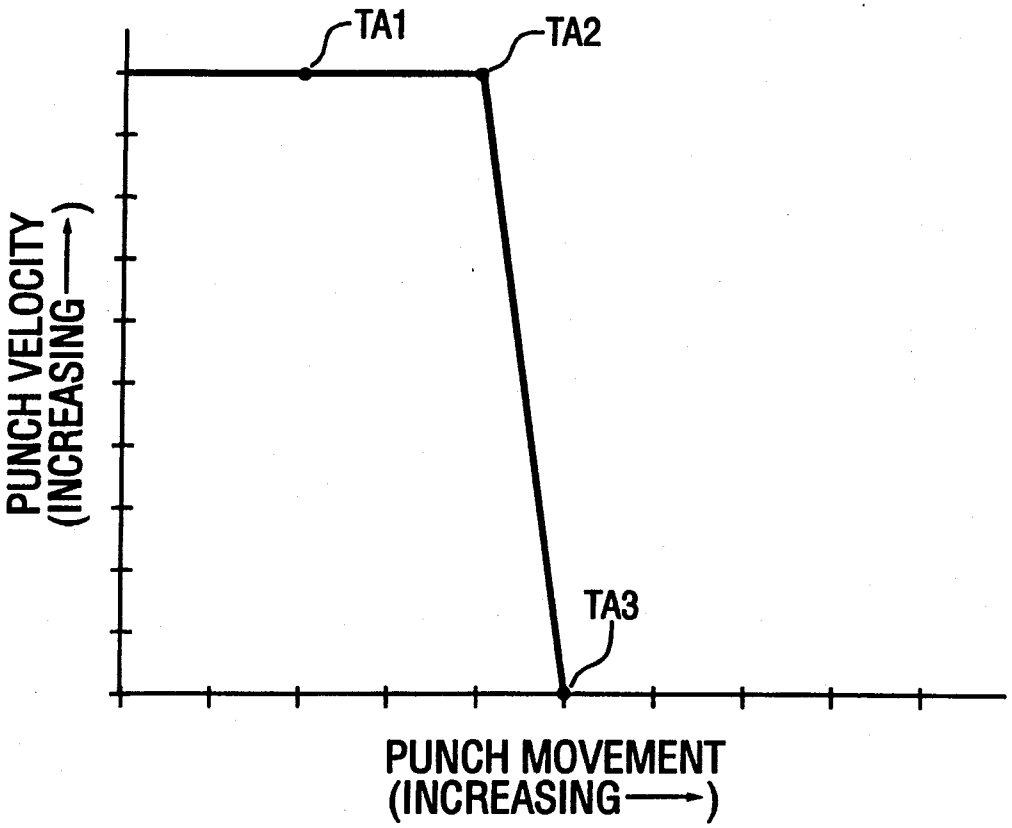
FIG. 4 (Prior Art)
FIG. 4 is a graph of the response time of the prior art hydraulic control system shown in FIG. 3.

When manifold valves 30 receive the position signal indicating that the desired downward position for punch 20 has been reached, manifold valves 30 will then shift and direct fluid flow to hydraulic line 42 as opposed to hydraulic line 32. However, manifold valves 30 generally do not instantaneously respond to the position signal, but rather, have a response lag time. Pump 22, though, provides a continuous fluid output. Thus, punch 20 will continue to move downward for a period of time after the position signal has been received because there is a response lag time for the manifold valves to shift fluid flow from hydraulic line 32 to hydraulic line 42. FIG. 4 illustrates an example of the response of punch 20 when using the hydraulic system of FIG. 3. At time TA1, a position signal is given to manifold valves 30 to stop the downward movement of punch 20. The response lag time for manifold valves 30 to begin shifting fluid flow is the difference between time TA1 and TA2.

Typical response lag times may range from 18 milliseconds to 26 milliseconds. Furthermore, the response lag time is not adequately repeatable and thus may vary from workpiece to workpiece. During this response lag time (TA1 to TA2), the punch continues to travel downward at full speed and the piece to piece variation in distance traveled during the lag time will vary proportionally to the response lag time variation. At time TA2, fluid begins to be diverted to hydraulic line 42. Punch 20 completely stops at time TA3. The total time to stop punch 20, TA3−TA1, and the distance that the punch travels during this time will vary as the time between TA1 and TA2 varies. FIG. 4 is used for illustrative purposes only since the time vs. speed graphs for various press brake systems will vary. Generally, though, a response lag time such as TA1 to TA2 will exist.

A press brake hydraulic control apparatus and method according to the present invention is shown in FIG. 5. Punch 20 is controlled by a hydraulic system that includes reservoir 24, manifold valves 30, cylinders 34 and 38, and hydraulic lines 26, 28, 32, 36, 40, and 42, all similar to the system shown in FIG. 3. A variable displacement piston pump 60, for example model AA10VSO16DRG available from Rexroth is provided. Such a pump has a remote pressure compensation valve or control head 51. For example, control head 51 may be control head model DRG available from Rexroth. Pressure changes at control head 51 are sensed and the output of pump 60 may be decreased in response to the sensed pressure change.

According to the present invention, D03 AC solenoid directional valve 50, for example a model DG4V3 valve available from Vickers is connected to pump 60 through hydraulic lines 54 and to reservoir 24 through hydraulic line 52. Hydraulic lines 52 and 54 are preferably ¼ inch lines, though other sizes may be used. Solenoid valve 50 is attached to pump 60 such that when solenoid valve 50 is closed, pump 60 provides full pump output to hydraulic line 28. However, when solenoid valve 50 is shifted, a pressure difference is sensed at control head 51 of pump 60 and the output of pump 60 is then decreased towards zero output. In a preferred embodiment, the system pressure is approximately 3000 psi. When solenoid valve 50 in closed, control head 51 therefore is sensing a high pressure. When solenoid valve 50 shifts, the pressure in line 54 falls to approximately 150 psi. This low pressure is sensed by control head 51 and pump 60 responds by decreasing output towards zero output.

According to the present invention, the downward movement of punch 20 is stopped by sending the position signal to both manifold valves 30 and solenoid valve 50 in order to begin halting fluid flow to the cylinders. The position signal is preferably generated as described above, however, other methods known in the art may be used. Thus, manifold valves 30 and solenoid valve 50 will both receive a position signal at approximately the same time to indicate that the valves should shift. However, solenoid valve 50 does not have the response lag time that manifold valves 30 generally have, and in fact solenoid valve 50 will shift nearly instantaneously as compared to the 18 to 26 millisecond delay in manifold valves 30. The output of pump 60 therefore begins to decrease before manifold valves 30 even shift. Because solenoid valve 50 shifts so quickly, any lack of repeatability in the solenoid shifting time generates minimal effects on the precision in forming workpieces.

Figure 6:
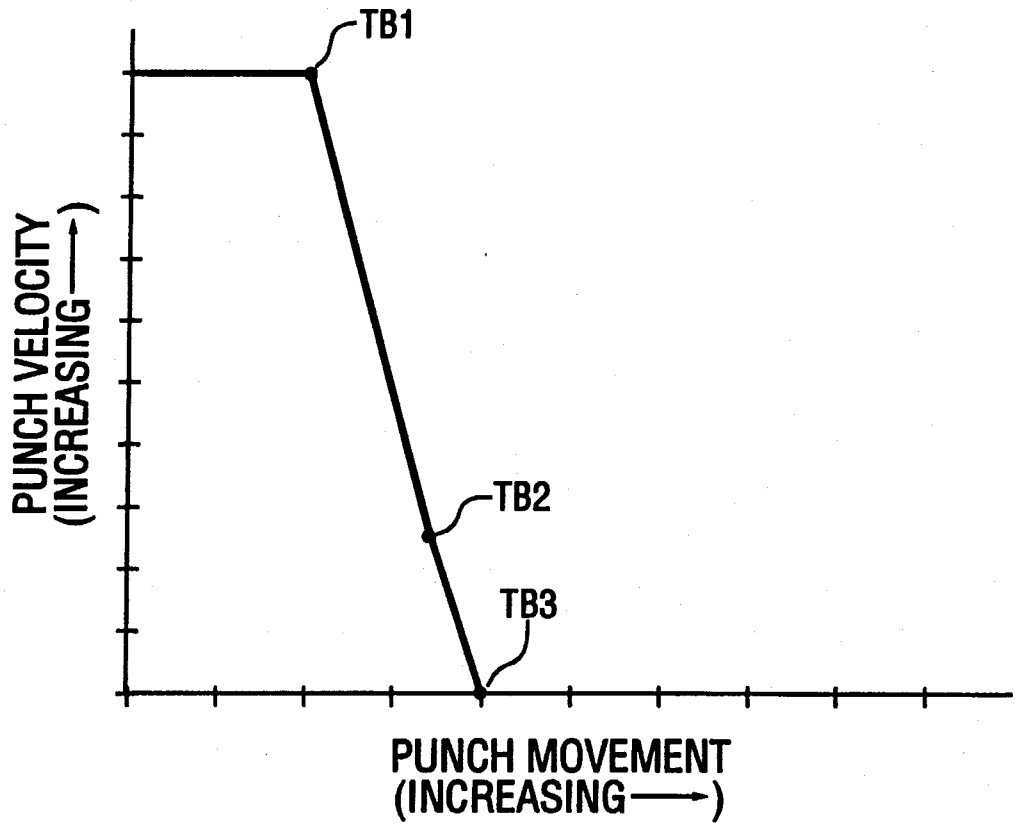
FIG. 6 is a graph of the response time according to the present invention of the hydraulic control system shown in FIG. 5.

FIG. 6 shows the response of punch 20 according to the present invention. At time TB1 a position signal is given to both manifold valves 30 and solenoid valve 50. As solenoid valve 50 shifts, a pressure difference is sensed at control head 51 and the pump output begins to decrease. Now during the manifold valve response lag time (TB1 to TB2), the punch velocity begins to decrease due to the lower pump output resulting from solenoid valve 50 quickly shifting. After the response lag time of manifold valves 30, time TB2, fluid also begins to be diverted from manifold valves 30 through line 42. Finally, punch 20 fully stops at time TB3.

Thus, the average punch speed during the time period from TB1 to TB2 is decreased. Because the average speed of the punch during the period TB1 to TB2 has decreased, the variation in the distance traveled by the punch that results from variations in the response lag time (TB2−TB1) will also decrease. It is noted, as with FIG. 3 above, the response time vs. speed graph is presented for illustrative purposes. These responses may vary depending on the user's specific application and needs and the other press brake components that are used in combination with the present invention.

It will be recognized that alternative hydraulic systems may utilize the present invention. For example, press brake systems may utilize more or less cylinders than shown in FIG. 5. Also, the methods of connecting, synchronizing and balancing the cylinders may vary. Further, various manifold valve systems may be used depending on the user's specific application. With such variations the advantages of the present invention may still be obtained by utilizing a variable pump that reduces pump output to directly reduce fluid flow to manifold valves or other flow bleed off mechanisms prior to the expiration of the response lag time of such manifold valves or mechanisms.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A workpiece forming apparatus, comprising:

a first die;

a movable ram including a second die configured to form a workpiece upon movement of said ram toward said first die; and a hydraulic system for controlling said movement of said ram, said hydraulic system comprising:

a hydraulic fluid reservoir, a variable displacement piston pump adapted to deliver hydraulic fluid under pressure from said reservoir to said ram, said pump being responsive to a position of said ram, during said movement of said ram, to reduce displacement of said pump, a manifold valve system connected to said pump, said manifold valve system being responsive to a position of said ram, during said movement of said ram, to divert hydraulic pressure away from said ram, and a pressure valve operable in response to a pressure change at said pressure valve to reduce said displacement of said pump by diverting hydraulic fluid away from said ram through said pressure valve.

2. The apparatus of claim 1, further comprising a solenoid valve connected to said pressure valve.

3. The apparatus of claim 1, further comprising:

a solenoid valve, said solenoid valve connected to a position sensor and responsive to a selected position of said ram; said position of said ram detected by said sensor during said movement of said ram; and a pressure compensation valve connected to said pump and said solenoid valve to reduce said displacement of said pump by diverting hydraulic fluid away from said ram through said valve.

4. The apparatus of claim 3, wherein said solenoid valve is connected to said reservoir.

5. A hydraulic system for a workpiece forming apparatus, comprising:

a variable output pump having an output port and having a hydraulic fluid flow;

a fast acting valve connected to said pump for diverting a portion of said hydraulic fluid flow away from said output port; and a manifold valve system connected to said output port of said pump for directing a hydraulic fluid flow from said output port to the apparatus.

6. The apparatus of claim 5, wherein said fast acting valve is a solenoid valve, said solenoid valve being connected to a position sensor and being responsive to a position signal of said position sensor.

7. The apparatus of claim 6, wherein said manifold valve system is connected to said position sensor and responsive to said position signal of said position sensor, said manifold valve system having a response lag time and said solenoid valve being responsive to said position signal during said response lag time.

8. Apparatus for controlling a press brake which brake includes a female die adapted to hold a workpiece, a punch, and a hydraulically actuated ram driving said punch toward said female die so as to shape the workpiece, said apparatus comprising:

a hydraulic fluid reservoir;

a variable displacement pump adapted to discharge hydraulic fluid from said reservoir, said pump including a pressure sensitive control head operable in response to a pressure drop at said control head to reduce the output of said pump;

a valve manifold operable in a first condition to deliver hydraulic fluid discharged from said pump to said ram, and in a second condition to deliver hydraulic fluid discharged from said pump back to said reservoir, bypassing the ram; and a normally closed valve connected between said control head of said pump and said reservoir and operable, as the valve manifold shifts from said first condition to said second condition, to effect said pressure drop on said pressure sensitive control head.

9. The apparatus of claim 8 further comprising a position sensor connected to said apparatus and positioned to detect a selected position of said punch said position sensor generating a position signal when said punch reaches said selected position wherein said normally closed valve is responsive to said position signal before said valve manifold is responsive to said position signal.

10. The apparatus of claim 8 wherein said normally closed valve comprises a solenoid valve.

11. Apparatus for use with a hydraulic press brake, including a ram and a manifold valve system operable in response to a stop signal during a work piece forming operation to shift valves in said manifold valve system and thereby stop the forming operation, said apparatus comprising:

a variable displacement pump operable to supply hydraulic fluid through said manifold valve system at sufficient pressure and output to said ram to effect the forming operation;

a remote pressure compensation valve connected to said pump and operable in response to a pressure at said compensation valve less than said pump pressure to decrease the output of said pump; and a normally closed solenoid valve shiftable from said closed condition in response to said stop signal to operate said remote pressure compensation valve and thereby reduce the output of said pump.

12. Apparatus for use with a hydraulic press brake, including a ram and a manifold valve system operable after a first response lag period in response to a position signal during a work piece forming operation to shift valves in said manifold valve system and thereby stop the forming operation, said apparatus comprising:

a variable displacement pump operable to supply hydraulic fluid through said manifold valve system at sufficient pressure and in sufficient output to said ram to effect the forming operation;

a remote pressure compensation valve connected to said pump and operable in response to a pressure change at said compensation valve to decrease the output of said pump; and a normally closed solenoid valve having a second response lag period less than said first response lag period, said solenoid valve shiftable from said closed condition in response to a position signal from said ram during said first lag period of said manifold valve system to operate said remote pressure compensation valve and thereby reduce the output of said pump.

* * * * *